United States Patent [19]

Sterk

[11] Patent Number: 4,949,460

[45] Date of Patent: Aug. 21, 1990

[54] HAIR TRIMMER

[75] Inventor: Olivier Sterk, Drachten, Netherlands

[73] Assignee: U.S. Philips Corp., New York, N.Y.

[21] Appl. No.: 301,918

[22] Filed: Jan. 13, 1989

[30] Foreign Application Priority Data

Jan. 21, 1988 [NL] Netherlands ..... 8800132

[51] Int. Cl.[5] ..... B26B 19/00; B26B 21/14; B26B 19/16; B26B 19/02

[52] U.S. Cl. ..... 30/201; 30/74; 30/200; 30/220; 30/233

[58] Field of Search ..... 30/200, 201, 202, 220, 30/233, 74, 49, 55

[56] References Cited

U.S. PATENT DOCUMENTS

| | | | |
|---|---|---|---|
| 2,731,720 | 1/1956 | Henard | 30/201 |
| 3,979,825 | 9/1976 | Baumann | 30/201 |
| 4,557,050 | 12/1985 | Haraguchi et al. | 30/201 |
| 4,669,189 | 6/1987 | Ullmann | 30/201 |
| 4,776,095 | 10/1988 | Tsujimoto et al. | 30/201 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

A hair trimmer is provided having a housing provided with a stationary cutter and a cutter which can be driven relative to the stationary cutter, the housing comprising a comb attachment which is adjustable relative to the housing. The housing is provided with a rotatable annular adjusting element which forms part of a spiral-groove coupling between the housing and the comb attachment.

5 Claims, 4 Drawing Sheets

HAIR TRIMMER

BACKGROUND OF THE INVENTION

The invention relates to a hair trimmer, comprising a housing provided with a stationary cutter and a cutter which can be driven relative to the stationary cutter, the housing being provided with a comb attachment which is adjustable relative to the housing.

Such a hair trimmer is known, for example from the examined Japanese Patent Application 59-32153. In this trimmer the comb attachment comprises laterally projecting actuating elements for the adjustment mechanism and the latching mechanism of this comb attachment. These projecting actuating elements are annoying during use of the trimmer and, moreover, it is not unlikely that the position of the comb attachment relative to the trimmer is altered by contact with other objects in spite of the latching mechanism.

SUMMARY OF THE INVENTION

An object of the invention is to solve these problems and to this end the invention is characterized in that the housing is provided with a rotatable annular adjusting element which forms part of a sprial-groove coupling between the housing and the comb attachment.

In preferred embodiments, the adjusting element is rotatably coupled to the comb attachment and a projection of the housing engages a spiral groove formed in the inner side of the adjusting element; or the adjusting element is rotatably coupled to the comb attachment and a projection of the adjusting element engages a spiral groove formed in the housing; or the adjusting element is rotatably mounted on a portion of the comb attachment and said portion is provided with a projection which engages a spiral groove formed in the inner side of the adjusting element; or the adjusting element is rotatably mounted on a portion of the comb attachment and the adjusting element comprises a projection which engages a spiral groove formed in said portion of the comb attachment.

DETAILED DESCRIPTION OF PREFERRED EMBODIMENTS

An embodiment of the invention will now be described in more detail, by way of example, with reference to the accompanying Figures.

The hair trimmer shown in the Figures comprises a housing 1 with a stationary cutter 2 and a cutter 3 which can be driven relative to the stationary cutter. The drivable cutter 3 is reciprocated in a manner known per se, so that the trimmer is particularly suitable, for example, for trimming a bread. For this purpose the trimmer comprises an accessory in the form of a comb attachment 4 which is adjustable relative to the housing 1.

Figure 1:
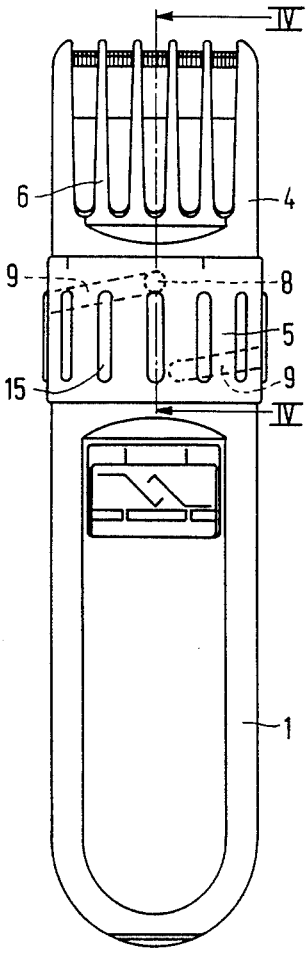
FIG. 1 is a front view of the hair trimmer.
Figure 2:
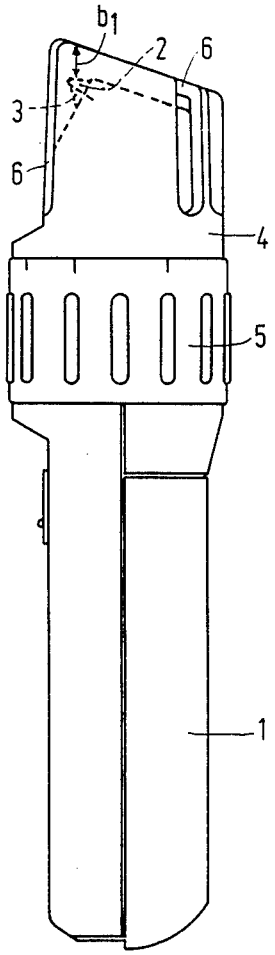
FIG. 2 is a side view of the hair trimmer shown in FIG. 1.
Figure 3:
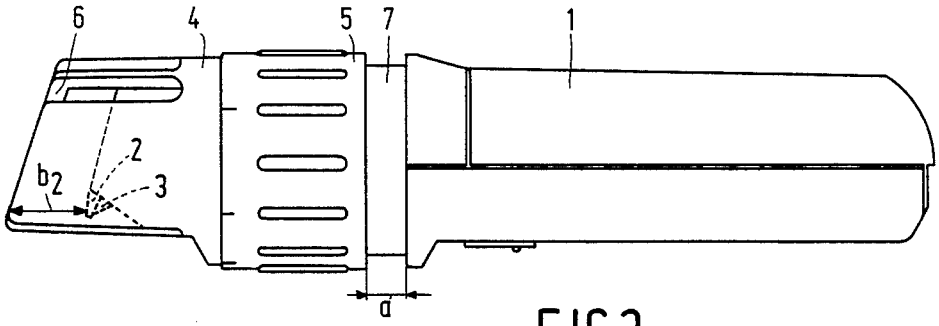
FIG. 3 is a side view similar to that shown in FIG. 2, but showing the comb attachment in another position.
Figure 4:
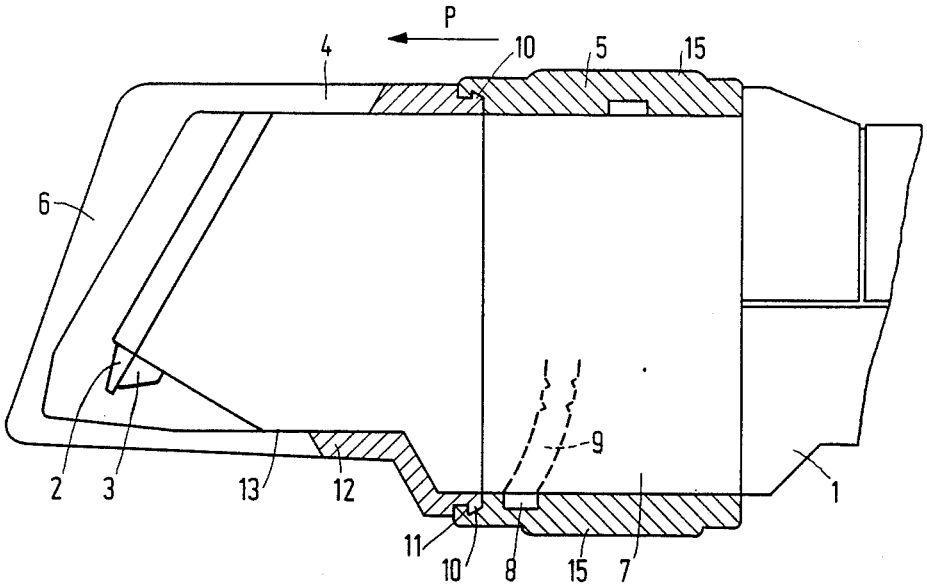
FIG. 4 is a partly sectional view taken on the line IV—IV in FIG. 1 and showing only the comb attachment and the adjusting element in cross-section.

For this adjustment the housing 1 is provided with an annular adjusting element 5 which is rotatable relative to the housing 1. The adjusting element 5 forms part of a spiral-groove coupling between the housing 1 and the comb attachment 4, so that, as will be explained in more detail hereinafter, the position of the comb attachment 4 relative to the housing 1 and hence relative to the cutters 2 and 3 can be changed by rotating the adjustment element 5. In the situation illustrated in FIG. 3 the comb attachment has been moved over a distance a in comparison with the situation shown in FIG. 2, so that the distance $b_2$ between the teeth 6 of the comb attachment and the cutters 2, 3 in FIG. 3 is an amount a larger than the corresponding distance $b_1$ in FIG. 2. In this way the trimmer can be adjusted to the particular beard length.

Figure 5:
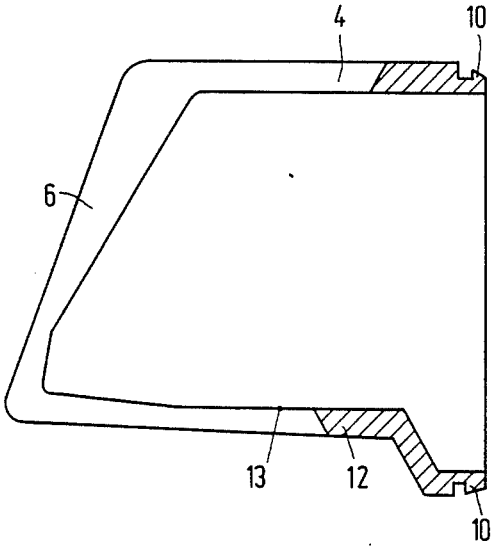
FIG. 5 shows the comb attachement in a longitudinal sectional view taken on the line V—V in FIG. 7.
Figure 6:
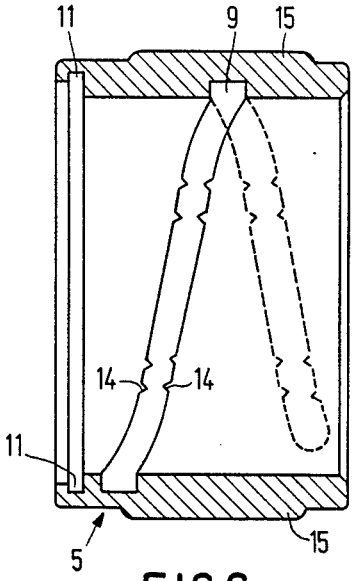
FIG. 6 is a longitudinal sectional view of the adjusting
Figure 7:
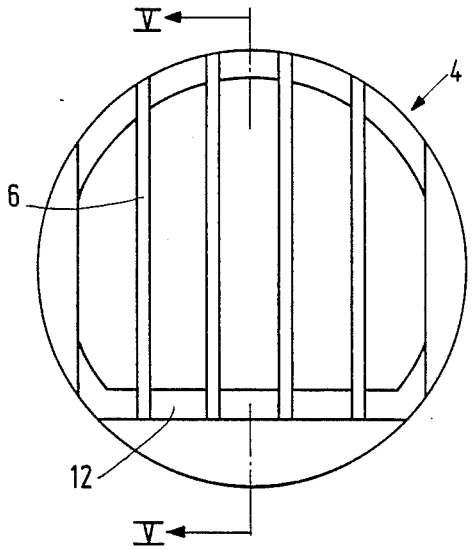
FIG. 7 is an end view of the comb attachment.
Figure 8:
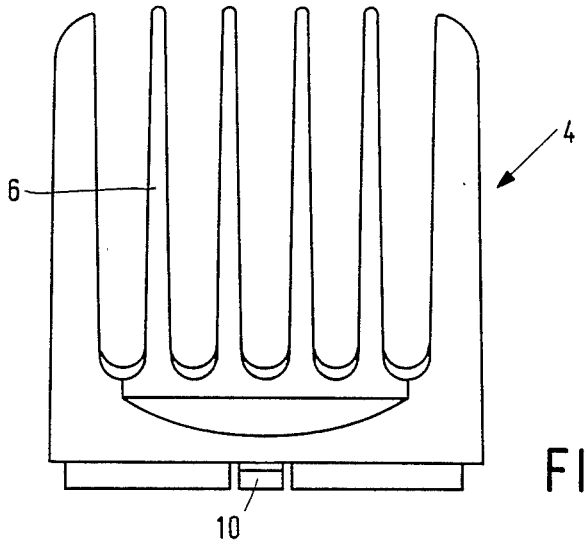
FIG. 8 is a front view of the comb attachment.

The adjusting element 5 is rotatably arranged on a cylindrical portion 7 of the housing 1. This portion 7 is provided with a projection 8 which engages a spiral groove 9 in the inner side of the adjusting element 5. The comb attachment 4 is coupled to the adjusting element 5 by means of the resilient hooks 10 of the comb attachment, which hooks engage the groove 11 in the adjusting element (see also FIGS. 5 and 6 ). By rotating the adjusting element 5 relative to the housing 1 the adjusting element is moved relative direction because the projection 8 engages in the spiral groove 9. As a result of the coupling between the adjusting element 5 and the comb attachment 4 this attachment will be moved in these directions. The comb attachment comprises a flat wall portion 12 which-engages against a corresponding wall portion 13, thereby preventing the comb attachment 4 from being rotated with the adjusting element 5.

In this way the comb attachment 4 can be adjusted simply by rotating the adjusting element 5. By means of the ridges 14 in the spiral groove 9 the projection 8 can be latched in the groove 9 and, consequently, the comb attachment can be latched relative to the housing in various positions. The adjusting element may be provided with ridges 15 to provide a better grip.

Obviously it is also possible to provide the adjusting element with a projection and to form the cylindrical portion 7 with a spiral groove.

Figure 9:
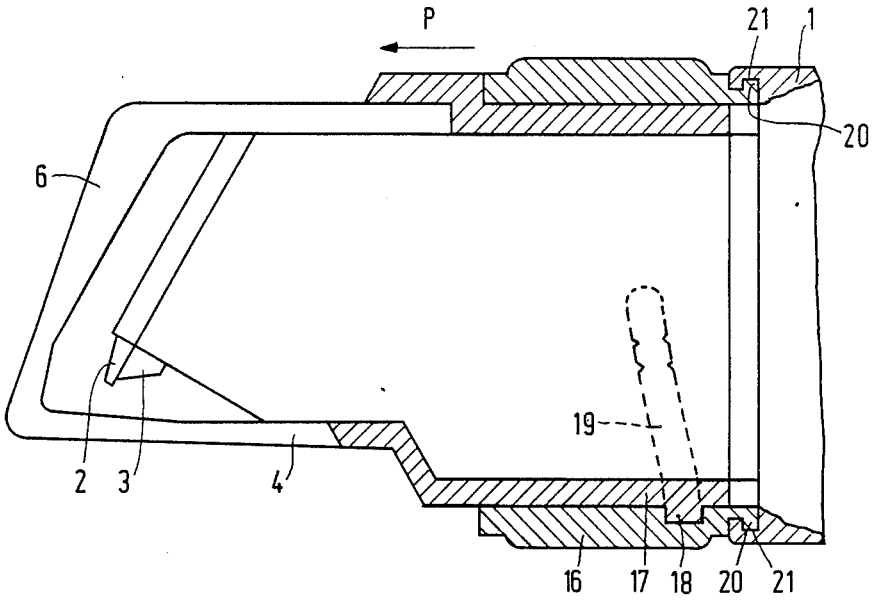
FIG. 9 shows a modification of the embodiment shown in FIGS. 1 to 8 in a sectional view similar to that in FIG. 4.

FIG. 9 finally shows an embodiment in which the adjusting element 16 is rotatably arranged on a cylindrical portion 17 of the comb attachment 4. In this embodiment a spiral-groove coupling is provided between the adjusting element 16 and said cylindrical portion 17, the cylindrical portion 17 being provided with a projection 18 and the adjusting element 16 being formed with a groove 19. The adjusting element 16 is rotatably coupled to the housing 1 by means of resilient hooks 20 which engage the groove 21 in the housing 1. In this way the comb attachment 4 is independently movable in the direction P or in the opposite direction.

I claim:

1. A hair trimmer, comprising a housing provided with a stationary cutter and a cutter which can be driven relative to the stationary cutter, the housing being provided with a comb attachment which is adjustable relative to the housing, a spiral-groove coupling between the housing and the comb attachment, said coupling comprising a rotatable annular adjusting element wherein the position of said comb attachment relative to the cutters may be changed by rotating said coupling comprising said adjusting element.

2. A hair trimmer as claimed in claim 1, wherein the adjusting element is rotatably coupled to the comb attachment, and a projection of the housing engages a spiral groove formed in the inner side of the adjusting element.

3. A hair trimmer as claimed in claim 1, wherein the adjusting element is rotatably coupled to the comb attachment and a projection of the adjusting element engages a spiral groove formed in the housing.

4. A hair trimmer as claimed in claim 1, wherein the adjusting element is rotatably mounted on a portion of the comb attachment and said portion is proivided with a projection which engages a spiral groove formed in the inner side of the adjusting element.

5. A hair trimmer as claimed in claim 1, wherein the adjusting element is rotatably mounted on a portion of the comb attachment and the adjusting element comprises a projection which engages a spiral groove formed in said portion of the comb attachment.

* * * * *